United States Patent [19]

Fanger et al.

[11] 4,396,381

[45] Aug. 2, 1983

[54] CLOSURE DEVICE FOR SPECIMEN-CONTAINERS SUCH AS TEST TUBES

[75] Inventors: Peter Fanger; Rolf Näff, both of Steinhausen; Theodor Schmidhauser, Bauma, all of Switzerland

[73] Assignee: Hoffmann-La Roche Inc., Nutley, N.J.

[21] Appl. No.: 222,928

[22] Filed: Jan. 6, 1981

[30] Foreign Application Priority Data

Jan. 15, 1980 [CH] Switzerland ..... 305/80

[51] Int. Cl.[3] ..... B04B 15/00; B65D 45/00

[52] U.S. Cl. ..... 494/85; 220/319; 220/352; 494/16

[58] Field of Search ..... 233/1 A, 1 R, 26; 220/319, 352, 315, 67; 494/85, 16, 38

[56] References Cited

U.S. PATENT DOCUMENTS

| | | | |
|---|---|---|---|
| 3,508,653 | 4/1970 | Coleman | 233/26 |
| 3,800,947 | 4/1974 | Smith | 210/117 |
| 4,087,043 | 5/1978 | Anderson | 233/1 A |
| 4,102,490 | 7/1978 | Chulay | 233/26 |
| 4,114,803 | 9/1978 | Romanauskas | 233/1 A |
| 4,166,573 | 9/1979 | Webster | 233/26 |
| 4,190,196 | 2/1980 | Larsen | 233/1 A |
| 4,222,513 | 9/1980 | Webster | 233/1 A |

FOREIGN PATENT DOCUMENTS

| | | |
|---|---|---|
| 2627133 | 2/1977 | Fed. Rep. of Germany . |
| 2756225 | 6/1978 | Fed. Rep. of Germany . |
| 2439622 | 10/1979 | France . |

*Primary Examiner*—Robert W. Jenkins

*Attorney, Agent, or Firm*—Jon S. Saxe; George M. Gould; Bernard S. Leon

[57] ABSTRACT

A closure device for a test tube to be used with an ultra-centrifuge comprising an insertion member, the insertion member including a bottom section which is adopted to be inserted into the test tube and has an outer diameter substantially equal to the inner diameter of the test tube and an upper section which extends upwardly from the test tube and has an outer diameter greater than the inner diameter of the said test tube, an abutment positioned outside of the test tube about the upper edge thereof, said abutment being adopted under the influence of centrifugal force to press against the outer surface of the upper edge of the test tube.

7 Claims, 4 Drawing Figures

CLOSURE DEVICE FOR SPECIMEN-CONTAINERS SUCH AS TEST TUBES

BACKGROUND OF THE INVENTION

The present invention relates to a closure device for specimen containers such as test tubes to be used with ultra-centrifuges. The closure device comprises a cap having an insertion portion which is adopted to be securely positioned in the open end of a test tube. The outer diameter of the lower part of the insertion portion which is adopted to be inserted into the test tube corresponds to the inner diameter of the tube.

Conventional closure devices for test tubes used in fixed-angle rotors of ultracentrifuge devices usually comprise an insertion portion which is adopted to be introduced into the open end of a test tube and a clamping means for clamping the test tube edge in the closure device thereby providing a firm, seal-tight connection between the test tube and the closure device. The lower portion of the insertion member is cylindrical and has an outer diameter corresponding to the inner diameter of the test tube. Said lower portion is introduced into the test tube. The upper portion on the insertion member is also cylindrical and contains a thin, threaded projection. To close the test tube, a clamping means is provided. The clamping means comprises a cover which has an outwardly or inwardly sloping conical surface and the cover is screwed to the thin threaded projection on the insertion member by a corresondingly-threaded nut. The cover's conical surface presses against the test tube edge either inwardly against a corresponding conical surface at the top edge of the cylindrical region of the insertion member, or outwardly, by means of an O-ring, against a correspondingly cylindrical projection on the cover.

Such common conventional closure devices have the disadvantage of being relatively expensive, owing to the number of individual parts which they comprise. In addition, a relatively large amount of time and work is required to screw the cover to the insertion member. An additional disadvantage is that a special screwing tool must be available.

DETAILED DESCRIPTION OF THE INVENTION

The object of the invention is to provide a simple closure device which is free from the disadvantages of the known closure devices but has the same reliability as that required of conventional closure devices used to stopper specimen containers which contain samples to be analyzed by the use of ultra-centrifuges.

According to the present invention, there is provided a closure device for specimen containers such as test tubes to be used in connection with ultra-centrifuge analyzers which is free of a screwing step to secure the closure device to the test tube. In achieving the objects of the present invention, the closure device comprises a closure which has a lower portion having an outer diameter corresponding to that of the inner diameter of the test tube and an upper portion which has a diameter greater than the inner diameter of the tube. An abutment is provided outside the tube and, under the influence of centrifugal force provided when a centrifuge is activated, the insertion member presses the test tube edge against the abutment.

Preferably, the abutment has a conical or flat annular surface concentric with the test tube or container axis.

In one embodiment of the present invention, the abutment forms a part of a ring which is slid upwardly on the test tube to secure the closure to the test tube. In another embodiment, the abutment can be formed in the rotor of the centrifuge itself.

Test tubes, which are usually made of plastics, either have the edge of their open ends formed without additional reinforcement or formed with a bead-like reinforcement or a kind of flange. If no reinforcement is provided at the test tube open end, the portion of the insertion member which is inserted into the tube has an additional thickened portion for widening the test tube, so as to produce at the upper edge of the tube, a conical surface corresponding to the abutment.

Figure 2B:
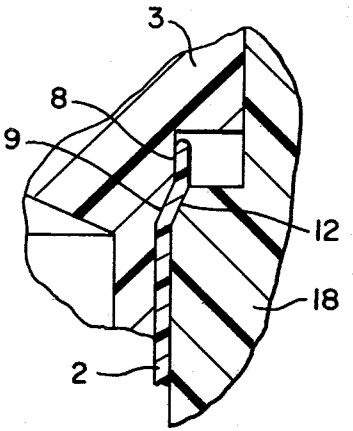
Figure 2C:
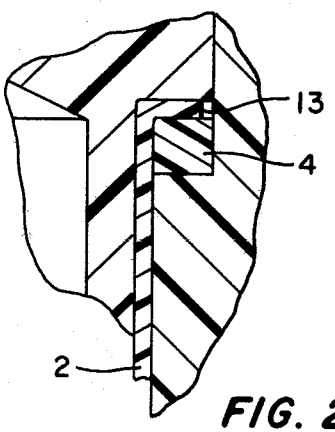
Figure 2A:
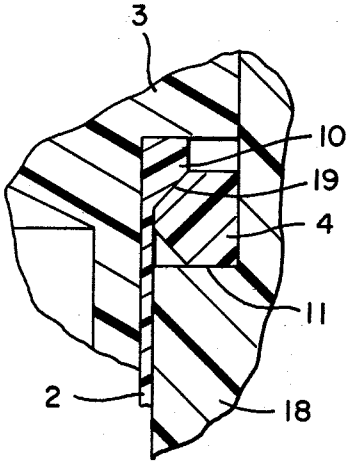
Figure 1:
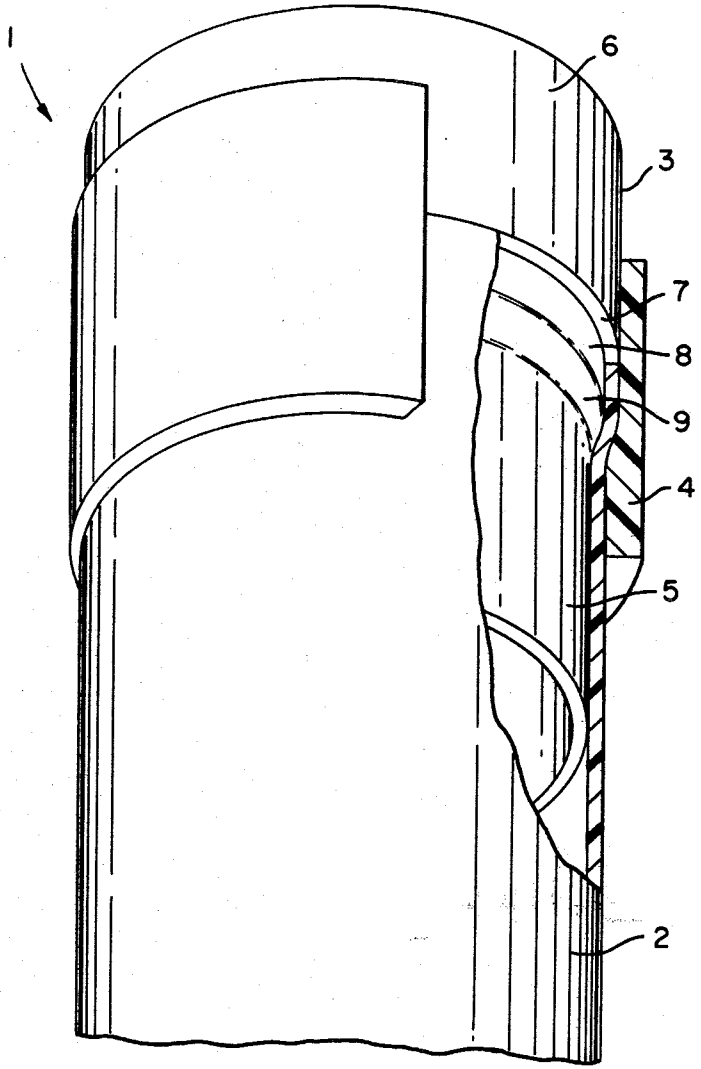

Embodiments of the invention will now be described with reference to the accompanying drawings in which:

FIG. 1 is a perspective view, partly cut away, of an embodiment of the closure device according to the invention, and FIGS. 2*a*, *b* and *c* are partial cross-sections through other embodiments of the closure device.

A closure device 1, shown in perspective in FIG. 1, is secured to a test tube 2 and comprises an insertion member 3 and a clamping ring 4. Insertion member 3 has a cylindrical lower neck portion 5 for insertion into test tube 2. The outer diameter of lower part 5 is about equal to the inner diameter of tube 2 for most of its length. The top portion 6 of insertion member 3 is likewise cylindrical but has a diameter which is greater than the inner diameter of the tube. Between the lower neck portion 5 and the top portion 6, there is a step 7 which abuts the upper edge of tube 2.

Below step 7, the lower portion 5 of insertion member 3 has a widened region 8. The outer diameter of region 8 is somewhat larger than the inner diameter of tube 2 but not large enough to prevent widened region 8 from being pushed with little force into the test tube thereby widening the portion of test tube 2 that widened region 8 comes into contact with when insertion member 3 is in its operative condition. A conical transition region 9 is formed between the widened region 8 and that part of lower neck portion 5 which has an outer diameter about equal to the inner diameter of the test tube.

As shown from the cross-section of the test tube in FIG. 1, the upper portion of the test tube 2 follows the contour of the transition region 9 and the widened region 8 when the insertion member 3 is positioned in test tube 2.

The second part of the closure device comprises ring 4, which surrounds insertion member 3 and the upper open end of the test tube when in its operative condition. The inner contour of ring 4 is configured such that it corresponds to the contour of the test tube when the insertion member 3 is slid or pushed into the test tube, i.e. the inner surface of ring 4, starting from the bottom, is first cylindrical with a diameter about equal to the outer diameter of the test tube, then conical and then cylindrical again with the inner diameter of ring 4 at the top thereof being about equal to the outer diameter of the top portion 6. The exact diameters of the conical and cylindrical regions of insertion member 3 and ring 4 are in relation to one another and to the wall thickness of tube 2 such that the upper part of the tube 2 is clamped when the closure device is assembled.

A test tube is easily closable by the use of the two-part closure device of this embodiment of the present invention. The insertion portion 3 is simply pushed or slid into the test tube opening until the upper edge of the test tube 2 abuts step 7. Next, ring 4 is pushed up over tube 2 until ring 4 is firmly held in place.

The thus-closed tube is placed in a suitable chamber of a fixed-angle rotor of a centrifuge. The rotor chamber is constructed so that its bottom part receives tube 2 and has a step bearing ridge at the place where the bottom edge of ring 4 is situated when the test tube is inserted. In this manner, when the centrifuge analyzer is activated with the test tube positioned therein under the influence of centrifugal force, the conical region of the inner wall of ring 4 forms an abutment against which the corresponding wall region of tube 2 is pressed by the conical transition region 9 of insertion member 3. As a result, the connection between the closure device and the test tube increases in efficiency as the centrifuge increases in speed, as a result of the increasing centifugal force.

Of course, within the preview of the present invention, the cooperating diameters of the insertion members and ring and the contour of the upper edge of the test tube can have shapes different from that shown in FIG. 1. Some further examples are shown in FIGS. 2*a* to 2*c*.

In the embodiment shown in FIG. 2*a*, the top edge of tube 2 has a peripheral enlargement 10. This enlargement has a conical bottom surface 19. Since, in this embodiment, the test tube already has a conical surface, member 3 can be simplified by omitting the thickened region 8 and the conical transition region 9. As before, however, ring 4 has a corresponding conical inner surface or abutment against which the enlargement 10 of the test tube is pressed under the influence of centrifugal force during centrifuging. As shown also in FIG. 2*a*, the underside of ring 4 is positioned against a step 11 in the rotor chamber.

FIG. 2*b* shows an additionally simplified closure device comprising only the insertion member 3. As before, the lower portion of member 3 has a widened region 8 and a conical transition region 9 as in FIG. 1. In the embodiment shown in FIG. 2*b*, however, ring 4 is replaced by a corresponding conical surface 12 on the rotor chamber wall 18. Centrifugal force presses the conical region of the test tube formed when the insertion member 3 is positioned in the test tube against the conical surface 12 of the rotor chamber 18.

FIG. 2*c* shows an embodiment in which the test tube has a peripheral flange 13 at its top edge. The flange, which is flat in the embodiment shown in FIG. 2*c*, rests upon a correspondingly flat surface of ring 4 and is pressed against the aforementioned flanged surface during centrifuging. In this embodiment, ring 4 can of course be omitted if a corresponding abutment surface is formed in the rotor chamber itself.

The closure device according to the invention can be made of the same materials, i.e. preferably aluminum or titanium, from which conventional closure devices are formed.

It is readily evident that the closure device according to the invention is much simpler than the known closure devices. It consists of only two members or in one embodiment only a single member. It is much easier to handle then the devices being presently marketed. The insertion and sliding of ring 4, if required, are acts which can be performed in seconds which significantly reduces the time over that required to apply conventional closure devices.

We claim:

1. A closure device for a test tube to be used with an ultra-centrifuge comprising an insertion member, the insertion member including a bottom section which is adopted to be inserted into the test tube and has an outer diameter substantially equal to the inner diameter of the test tube and a one-piece, nonthreaded upper section which extends upwardly from the test tube and has an outer diameter greater than the inner diameter of the said test tube, an abutment positioned outside of the test tube about the upper edge thereof, said abutment being adopted under the influence of centrifugal force to press against the outer surface of the upper edge of the test tube.

2. A closure device as defined in claim 1 in which the abutment has a conical or flat annular surface concentric with the test tube axis.

3. A closure device as defined in claim 2 in which between the lower section of the insertion member and the upper section, there is provided a transition region which has a slightly larger diameter than the inner diameter of the test tube whereby such region engages the inner surface of the test tube contiguous with the test tube upper edge upon insertion of the insertion member into the tube causing a widening of the upper edge portion of the test tube.

4. A closure device as defined in claim 3 in which the contour of the transition region corresponds to the configuration of the abutment.

5. A closure device as defined in claim 3 in which the transition region of the insertion member is conical and the abutment has the same conical configuration as the said transition region.

6. A closure device as defined in claim 1 in which the abutment comprises a part of a ring which is slidable mounted on the test tube, the surface of the abutment facing the test tube is configured to correspond to the outer surface of the upper edge of the test tube, whereby when said ring is slid upwardly on the test tube, the abutment engages the outer surface of the upper edge of the test tube.

7. A closure device in accordance with claim 1 in which the abutment is provided on the inner wall of a rotor chamber of the centrifuge.

* * * * *